US005586878A

United States Patent [19]

Döbbeling et al.

[11] Patent Number: 5,586,878

[45] Date of Patent: Dec. 24, 1996

[54] PREMIXING BURNER

[75] Inventors: Klaus Döbbeling, Nussbaumen; Johannes Santner; Christian Steinbach, both of Neuenhof, all of Switzerland

[73] Assignee: ABB Research Ltd., Zurich, Switzerland

[21] Appl. No.: 552,088

[22] Filed: Nov. 2, 1995

[30] Foreign Application Priority Data

Nov. 12, 1994 [DE] Germany ..... 44 40 558.8

[51] Int. Cl.[6] ..... F23D 14/46

[52] U.S. Cl. ..... 431/351; 431/173; 431/354

[58] Field of Search ..... 431/350, 351, 431/284, 353, 354, 8, 10, 173, 187; 60/464, 743

[56] References Cited

U.S. PATENT DOCUMENTS

| | | | |
|---|---|---|---|
| 4,781,030 | 11/1988 | Hellat | 431/351 |
| 4,932,861 | 6/1990 | Keller | 431/8 |
| 5,169,302 | 12/1992 | Keller | 431/351 |
| 5,307,634 | 5/1994 | Hu | 60/737 |

FOREIGN PATENT DOCUMENTS

| | | |
|---|---|---|
| 0321809B1 | 6/1989 | European Pat. Off. . |
| 0496016A1 | 7/1992 | European Pat. Off. . |

*Primary Examiner*—James C. Yeung

*Attorney, Agent, or Firm*—Burns, Doane, Swecker & Mathis, L.L.P.

[57] ABSTRACT

In a premixing burner of the double-cone design for operating an internal combustion engine, a combustion chamber of a gas-turbine group, or a firing plant, having a high-pressure atomization nozzle (3), arranged at the cone apex, for atomizing liquid fuel, which high-pressure atomization nozzle (3) consists of a nozzle body in which at least one feed passage (24) is arranged for the liquid fuel (12) to be atomized, which can be fed at a pressure greater than 100 bar, and this feed passage (24), with or without a turbulence chamber (25) arranged in between, is connected via at least two nozzle bores (18) to the interior space (14) of the burner, the nozzle bores (18) are aligned with the zones of high air velocity in the burner, and the angle (β) between the fuel-droplet spray (4) and the longitudinal axis (5) of the burner is at least as large as the cone half angle (β) between the sectional cone bodies (1, 2) and the longitudinal axis (5) of the burner. Fine atomization is thereby combined with a high fuel impulse, which is the precondition for quick vaporization of the fuel as well as for good premixing.

8 Claims, 7 Drawing Sheets

PREMIXING BURNER

FIELD OF THE INVENTION

The invention relates to a low-pollution premixing burner of the double-cone design for operating an internal combustion engine, a combustion chamber of a gas-turbine group, or a firing plant. More particularly, the invention is directed to a double cone burner having a high-pressure atomization nozzle, arranged at the apex of the conical hollow space, for atomizing liquid fuel, the nozzle optionally including a turbulence chamber and being connected via at least two nozzle bores to the interior space of the burner.

BACKGROUND

Atomizer burners are known in which the oil for combustion is finely distributed in a mechanical manner. The oil is broken up into fine droplets of about 10 to 400 μm diameter (oil mist) which vaporize and burn in the flame while mixing with the combustion air. In pressure atomizers (see Lueger-Lexikon der Technik, Deutsche Verlags-Anstalt Stuttgart, 1965, volume 7, p. 600), the oil is fed under a pressure of about 4 to 25 bar to an atomizer nozzle by an oil pump. The oil passes through essentially tangentially running slots into a swirl chamber and leaves the nozzle via a nozzle bore. The oil particles are thereby given two component motions—an axial component motion and a radial component motion. The oil film issues from the nozzle bore as a rotating hollow cylinder, and expands through centrifugal force to form a hollow cone. The margins of the fuel cone, however, start to vibrate in an unstable manner and break into small oil droplets. The atomized oil forms a cone having a more or less large opening angle.

However, in the case of the low-pollution combustion of mineral fuels in modern burners, for example in premixing burners of the double-cone design, which in their basic construction are described in U.S. Pat. No. 4,932,861 to Keller et al., special requirements are imposed on the atomizing of the liquid fuel. These are in particular as follows:

1. The droplet size must be small so that the oil droplets can vaporize completely before combustion.

2. The opening angle (expansion angle) of the oil mist is to be small.

3. The droplets must have a high velocity and a high impulse in order to be able to penetrate far enough into the compressed combustion-air mass flow so that the fuel vapor can premix completely with the combustion air before reaching the flame front.

Swirl nozzles (pressure atomizers) and air-assisted atomizers of the known designs having a pressure of up to about 100 bar are scarcely suitable for this, since they do not permit small expansion angles, the atomizing quality is restricted, and the impulse of the droplet spray is low.

As a consequence of inadequate vaporizing and premixing of the fuel, the addition of water is necessary for lowering the flame temperature and thus reducing NOx formation. Since the fed water also often disturbs flame zones, which certainly produce little NOx per se but are very important for the flame stability, instability such as flame pulsation and/or poor burn-out often occurs, which leads to the increase in the CO exhaust.

An improvement can be achieved with the high-pressure atomizer nozzle disclosed by EP 0 496 016 A1. This high-pressure atomizer nozzle consists of a nozzle body in which a turbulence chamber is formed which is connected via at least one nozzle bore to an exterior space. The nozzle has at least one feed passage for the liquid to be atomized, which can be fed under pressure. The cross sectional area of the feed passage leading into the turbulence chamber is greater than the cross sectional area of the nozzle bore by the factor 2 to 10. This arrangement enables a high level of turbulence to be produced in the turbulence chamber, which does not abate on the way from the turbulence chamber to the discharge from the nozzle. The liquid jet is rapidly disintegrated in the exterior space, that is, after leaving the nozzle bore, by the turbulence produced in front of the nozzle bore, in the course of which small expansion angles of 20° or less result. The droplet size is likewise very small. Only the loss of fuel impulse in the turbulence generator is disadvantageous, which does not permit directed introduction.

SUMMARY OF THE INVENTION

Accordingly, one object of the invention, in attempting to avoid all these disadvantages, is to provide a novel low-pollution premixing burner of the double-cone design which has a high-pressure atomization nozzle for atomizing liquid fuel, which high-pressure atomization nozzle is of simple construction and with which a very good atomization quality is achieved with at the same time a high fuel impulse.

According to the invention this is achieved in a premixing burner of the double-cone design in which nozzle discharge bores of the high-pressure atomization nozzle are aligned with the zones of high air velocity, and the angle of the fuel spray to the axis of the burner is at least as large as the cone half angle of the burner.

The advantages of the invention consist, inter alia, in a high-pressure atomization nozzle that produces fine atomization of the fuel combined with a high fuel impulse and thus quick vaporization of the fuel as well as good premixing of the fuel spray with the combustion air. The high-pressure atomization nozzle is of simple construction, is readily accessible inside the burner and is distinguished by only a small space requirement at the burner apex. The fuel can be injected specifically into zones of high air velocity. The necessity of adding water for the purpose of reducing the NOx emissions is dispensed with, for the NOx emissions are very low on account of the aforesaid fine atomization, quick vaporization of the fuel and the good premixing of the fuel spray with the combustion air.

It is especially convenient when the nozzle bores of the high-pressure atomization nozzle are aligned with the air-inlet slots of the conical sectional bodies, since in this case the premixing of the fuel spray with the incoming combustion air is most intensive.

Furthermore, it is advantageous when the high-pressure atomization nozzle is a turbulence-assisted high-pressure nozzle having a turbulence chamber arranged in front of the nozzle bores, the turbulence chamber being defined by a tube, and having a conical cap on the axial end of the tube, in which the nozzle bores are arranged, and a filling piece having at least one feed opening, which is preferably arranged centrally in the filling piece. Rapid disintegration of the liquid jet and an especially fine droplet spray are achieved by the turbulence produced in front of the nozzle bore. In addition, the resulting droplet spray is distinguished by small expansion angles.

Finally, a high-pressure orifice nozzle is advantageously used as the high-pressure atomization nozzle, which high-pressure orifice nozzle consists of a tube and a conical cap of the tube, in which the nozzle openings are arranged. In this case, a very high fuel impulse is achieved which permits deep penetration of the fuel spray into the combustion air.

Furthermore, it is advantageous when the nozzle bores are arranged in the outer third of the conical cap close to the wall of the tube. Very good atomization quality is then achieved.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings showing two exemplary embodiments of the invention in the case of a double-cone burner for operating a gas turbine, wherein.

Only the elements essential for understanding the invention are shown. The direction of flow of the media is designated by arrows.

DESCRIPTION OF THE PREFERRED EMBODIMENTS

Figure 1:
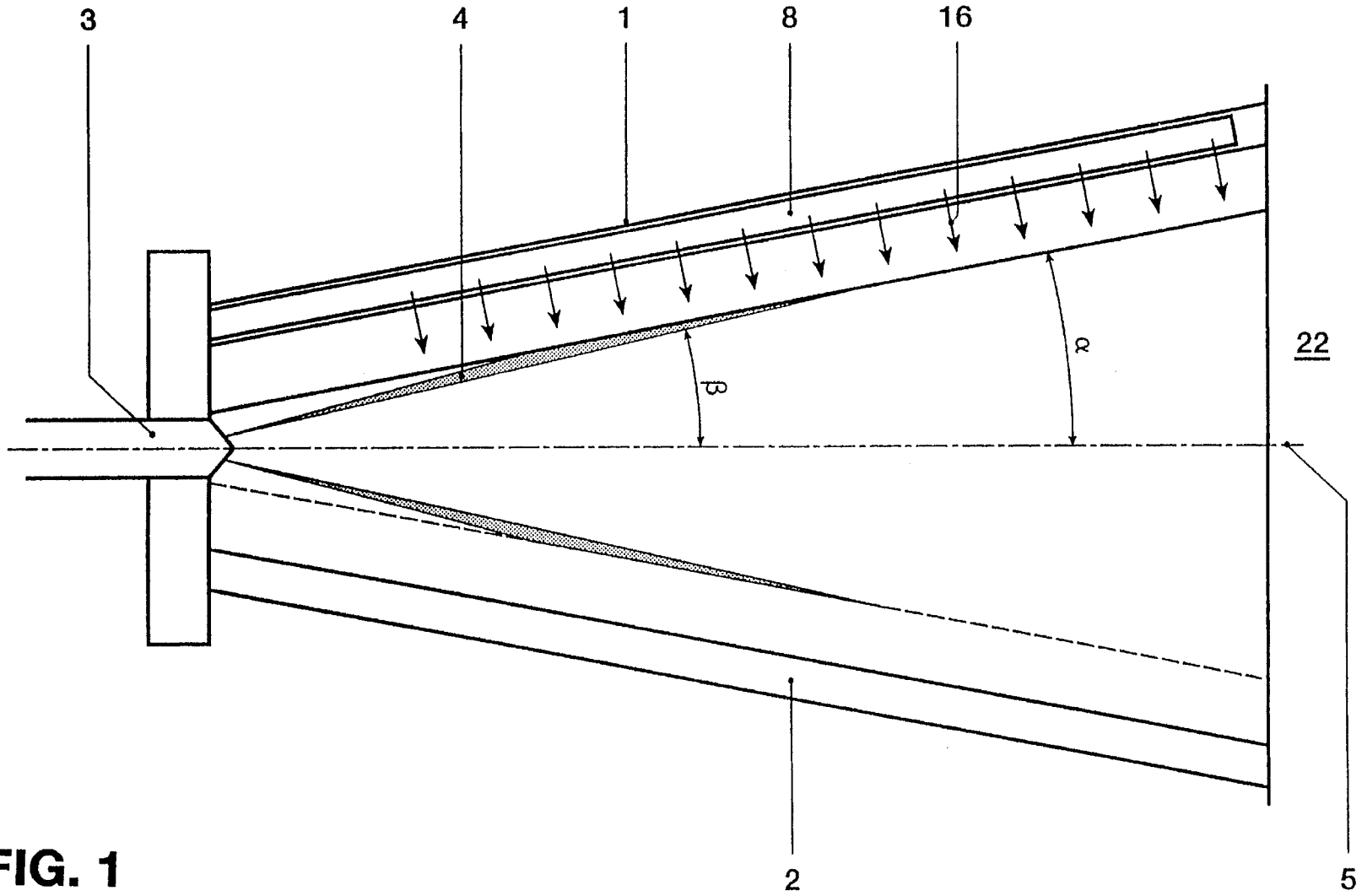
FIG. 1 shows a schematic view of a double-cone burner.
Figure 3:
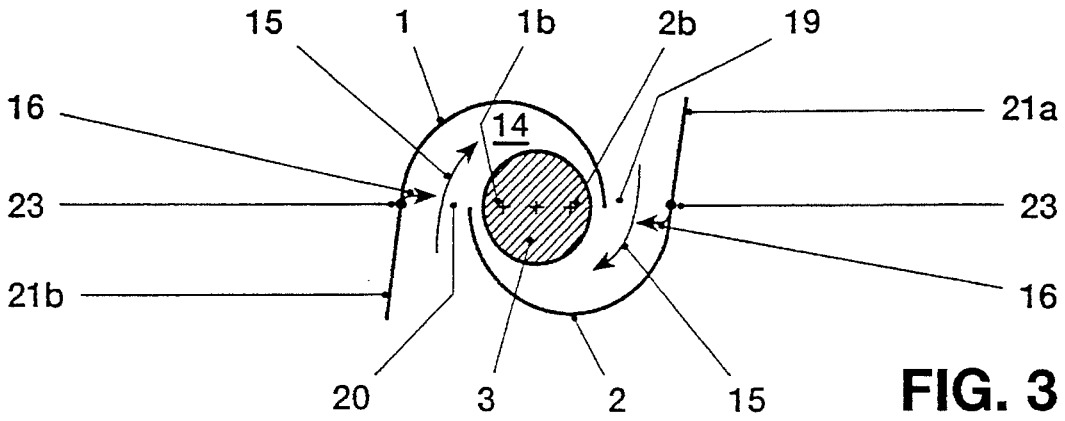
FIG. 3 shows a simplified section in plane III—III according to FIG. 2.
Figure 4:
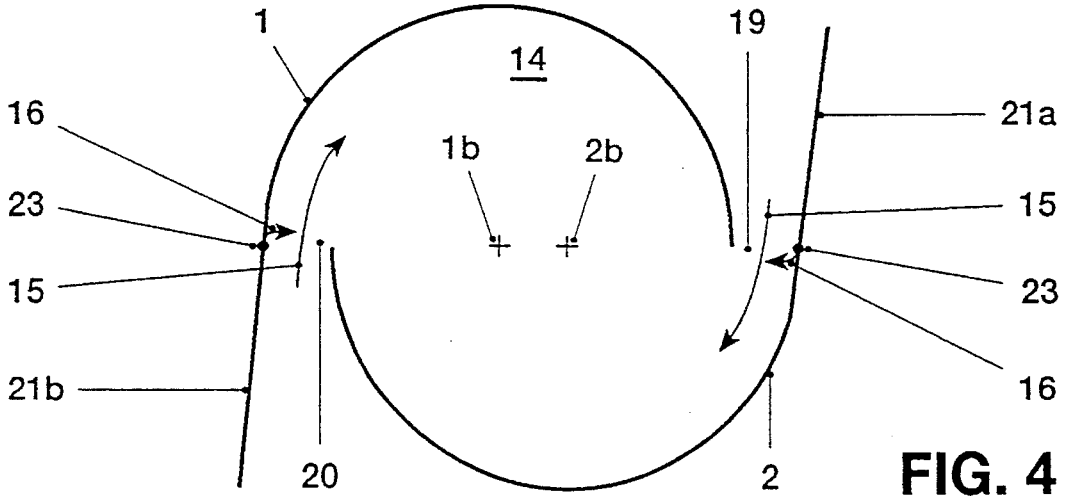
FIG. 4 shows a simplified section in plane IV—IV according to FIG. 2.
Figure 5:
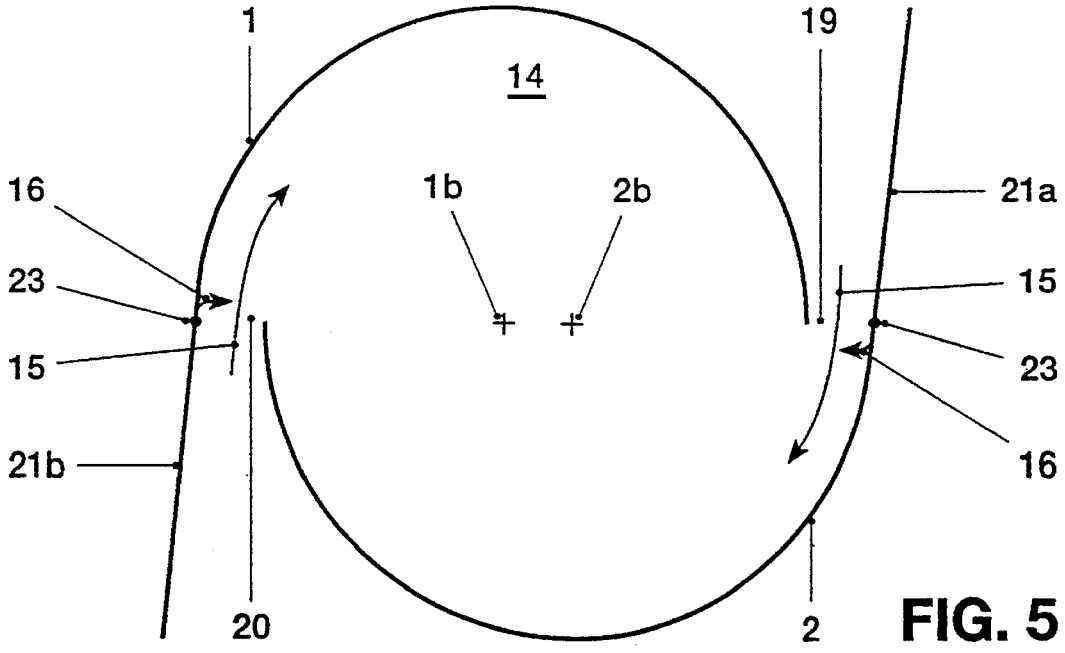
FIG. 5 shows a simplified section in plane V—V according to FIG. 2.

Referring now to the drawings, wherein like reference numerals designate identical or corresponding parts throughout the several views, FIG. 1 schematically shows a section through the premixing burner, which essentially comprises two sectional cone bodies 1, 2 and the basic construction of which is described in U.S. Pat. No. 4,932,861 to Keller et al. To better understand the burner construction it is advantageous if FIG. 2 and the sections apparent therein according to FIGS. 3 to 5 are used at the same time.

Figure 2:
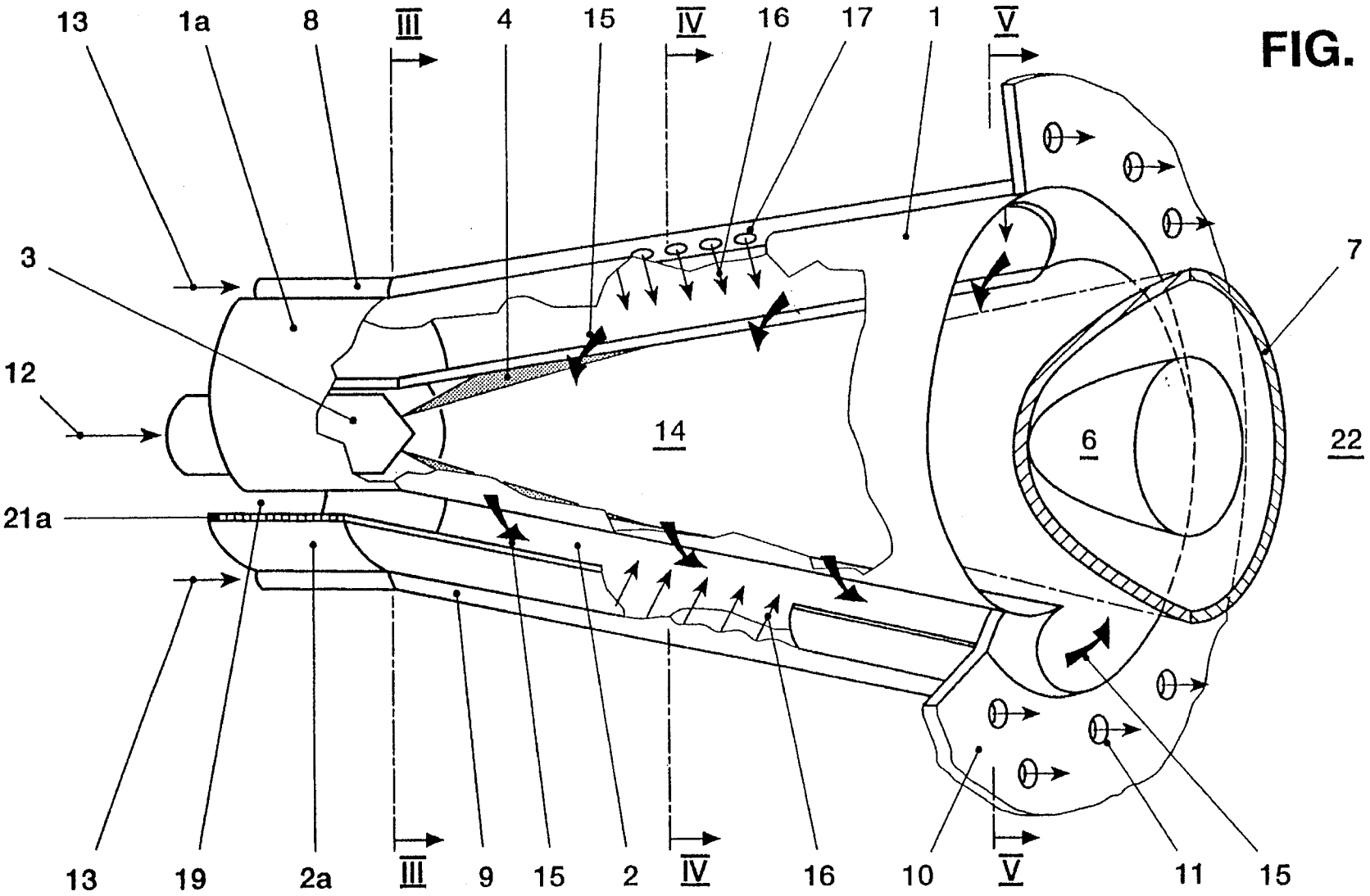
FIG. 2 shows a burner according to FIG. 1 in perspective.

FIG. 2 shows in perspective representation the double-cone burner with integrated premixing zone. The two sectional cone bodies 1, 2 are offset from one another relative to their longitudinal symmetry axes 1*b*, 2*b*. Tangential flow air-inlet slots 19, 20 are thereby obtained in an opposed inflow arrangement on both sides of the space enclosed by the sectional cone bodies 1, 2. The air-inlet slots 19, 20 allow a tangentially directed flow of combustion air 15 into the interior space 14 of the burner, i.e. into the conical hollow space formed by the two sectional cone bodies 1, 2. The sectional cone bodies 1, 2 widen in the direction of flow at a constant angle $\alpha$ to the burner axis 5. The two sectional cone bodies 1, 2 each have a cylindrical initial part 1*a*, 2*a*, which parts are likewise offset. Located in this cylindrical initial part 1*a*, 2*a* is a high-pressure atomization nozzle 3 having at least two nozzle openings 18 which are arranged approximately in the narrowest cross section of the conical interior space 14 of the burner. The burner can of course also be embodied without a cylindrical initial part, that is, it can be embodied in a purely conical manner.

The two sectional cone bodies 1, 2 each have a fuel feed line 8, 9 along the air-inlet slots 19, 20. The fuel feed lines 8, 9 are disposed on the longitudinal side with openings 17 through which a further fuel 13 (gaseous or liquid) flows. This fuel 13 is mixed with the combustion air 15 flowing through the tangential flow air-inlet slots 19, 20 into the burner interior space, which is shown by the arrows 16. Mixed operation of the burner via the nozzle 3 and the fuel feed lines 8, 9 is possible.

Arranged on the combustion-space side is a front plate 10 having openings 11 through which diluent air or cooling air is fed to the combustion space 22 when required. In addition, this air feed ensures that flame stabilization takes place at the outlet of the burner. A stable flame front 7 having a backflow zone 6 appears there.

The arrangement of baffle plates 21*a*, 21*b* can be gathered from FIGS. 3 to 5. The baffle plates 21*a*, 21*b* can be opened and closed, for example, about a pivot 23 so that the original gap size of the tangential air-inlet slots 19, 20 is thereby changed. The burner can of course also be operated without these baffle plates 21*a*, 21*b*.

Figure 6:
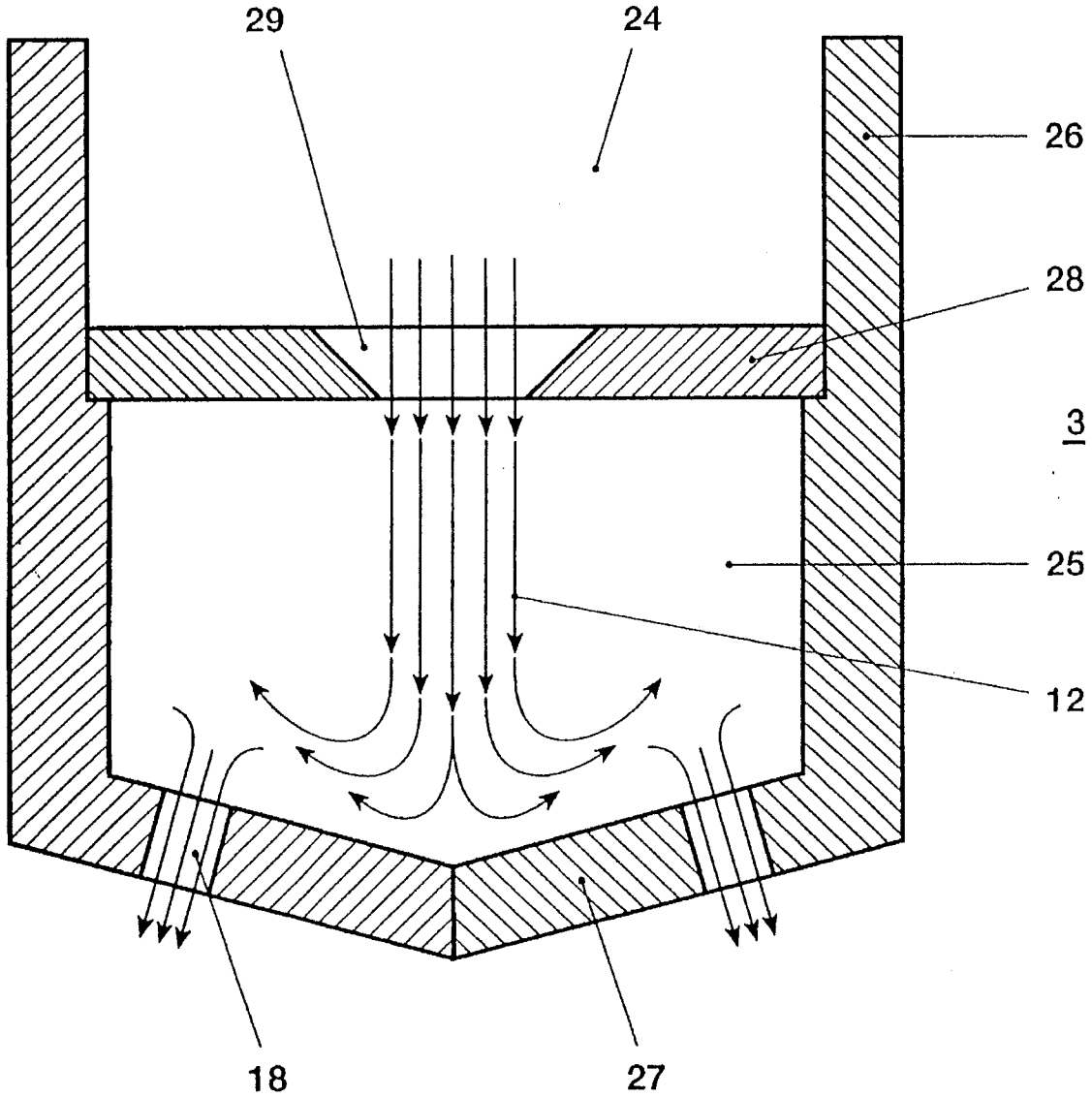
FIG. 6 shows a longitudinal section through the turbulence-assisted high-pressure atomization nozzle in the plane of the nozzle bores.

FIG. 6 depicts a turbulence-assisted high-pressure atomization nozzle 3 which, as shown in FIG. 1 or FIG. 2, is arranged at the cone apex of the burner. The nozzle 3 consists of a tube 26 which surrounds a feed passage 24 and a turbulence chamber 25. The tube 26 is closed off by a conical cap 27. The cap has two nozzle bores 18 in the outer third close to the tube wall. These nozzle bores 18 communicate between the turbulence chamber 25, located in the tube 26, and the interior space 14 (conical hollow space) of the burner. The turbulence chamber 25 is bounded, in addition to the tube 26, by a filling piece 28 and the cap 27 of the tube 26. A feed opening 29 for the fuel 12 to be atomized is arranged centrally in the filling piece 28. Of course this opening can alternatively be positioned eccentrically or there can be a plurality of feed openings 29. It is advantageous when the feed opening 29 has a cross section narrowing in the direction of flow, as shown in FIG. 6.

The fuel 12 to be atomized flows under a pressure of greater than 100 bar via the feed line 24 and the opening 29 into the turbulence chamber 25, which has a cross section widening abruptly relative to the feed opening 29. The fuel jet strikes the cone apex of the conical cap 27. Intensive shearing actions and the rebounding of the jets from the surface of the cap produce a high level of turbulence, which does not abate on the short way up to the discharge from the nozzle. The jet of liquid is rapidly disintegrated in the burner interior space 14 by the turbulence produced in front of the two nozzle bores 18, in the course of which very small expansion angles result.

The fuel 12 is readily atomized by the high impulse and the consequently high velocity relative to the air. The fuel in the jet has a high penetration depth and thus leads to a high intermixing quality.

The alignment of the nozzle bores 18 with the tangential air-inlet slots 19, 20, that is, with zones of very high air velocity, leads to direct intermixing of the fuel 12 present in the form of a finely distributed droplet spray 4. The fuel is distributed very effectively along the burner wall in the combustion-air flow 15. It intermixes very readily along the cone with the fresh air flow at the end of the burner so that excellent premixing is achieved, which has a favorable effect on a low value of the pollutant emissions.

Figure 7:
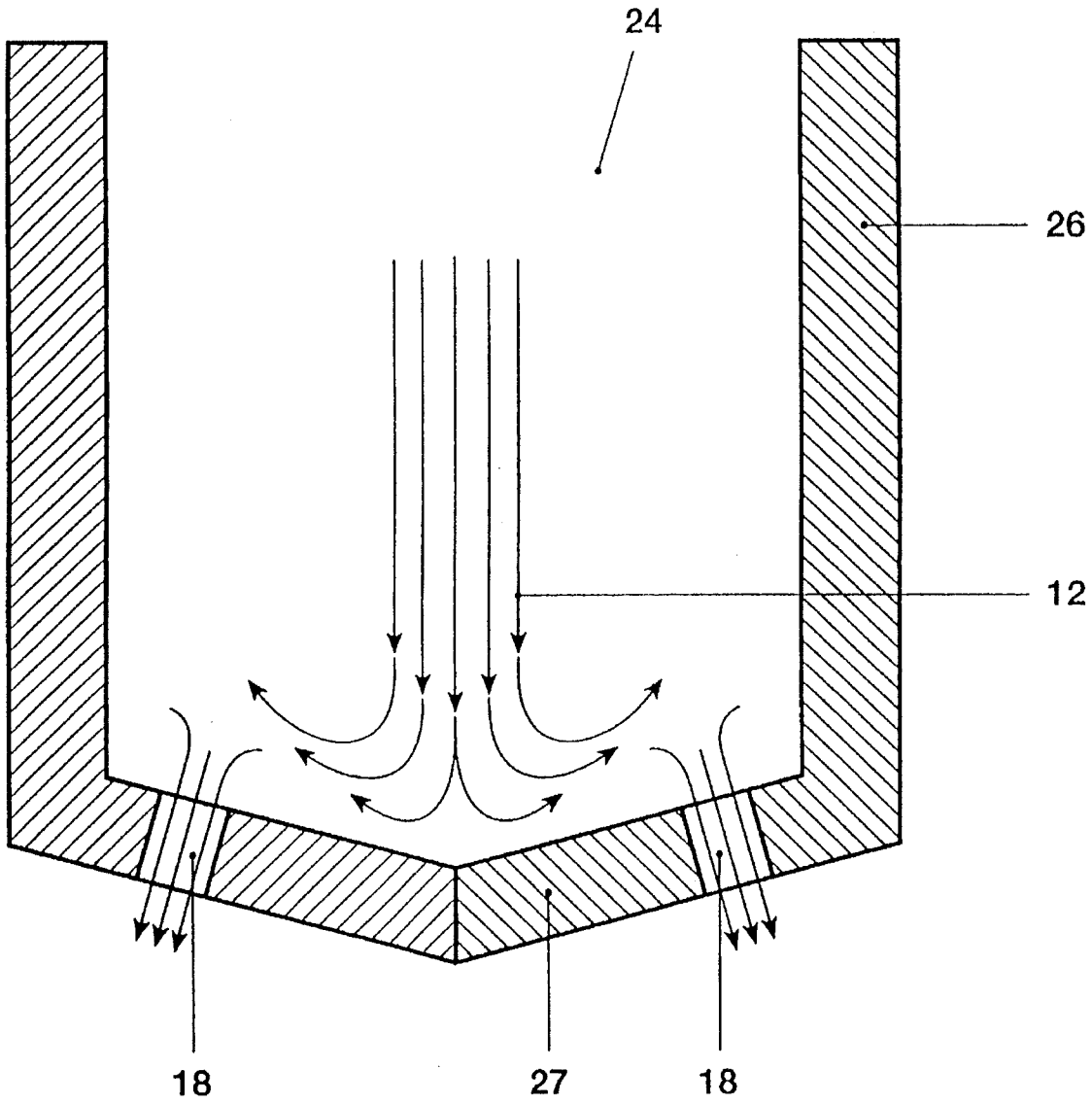
FIG. 7 shows a longitudinal section of the high-pressure orifice nozzle in the plane of the nozzle bores.

FIG. 7 shows a second exemplary embodiment. Here, the high-pressure atomization nozzle 3 is a multi-hole high-pressure orifice nozzle which corresponds in its construction to the aforesaid turbulence-assisted nozzle, although there is of course no turbulence chamber in the orifice nozzle. This means that in this case the achievable fuel-droplet size under comparable conditions to the first exemplary embodiment is certainly slightly larger (see FIG. 8), but a high fuel impulse can be achieved instead, which through the specific injection in zones of high air velocity likewise leads to the aforesaid advantages.

The cross section of the nozzle 3, its position and the injection direction result from the desired throughput (as a function of the supply pressure) with due regard to sufficiently high Reynolds numbers in the nozzle bores 18.

Figure 8:
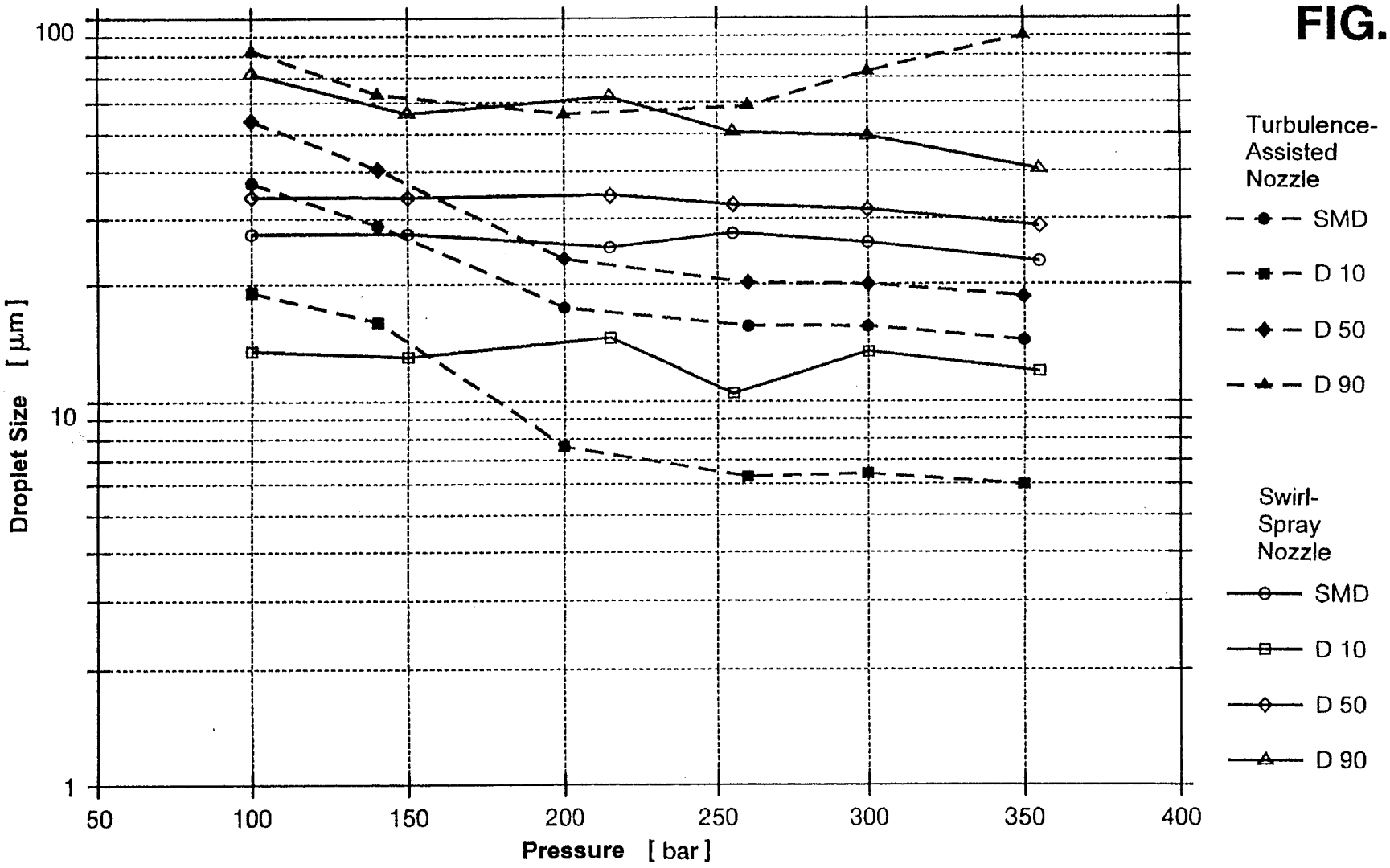
FIG. 8 shows a diagram for illustrating the dependency of the droplet size on the pressure of a high-pressure atomization nozzle according to FIG. 6 or 7.

The diagram shown in FIG. 8 illustrates for a turbulence-assisted pressure atomization nozzle the dependency of the droplet diameter $d_T$ on the supply pressure p for various limit diameters of the droplet mass distribution. Dx designates the limit diameter, which x mass % of all particles fall below. SMD is the Sauter diameter, that is, the diameter of a droplet which has the same ratio of surface to volume as the entire jet. Here, the high-pressure atomization nozzle forming the basis of the diagram had water admitted to it and had the following characteristics:

| | |
|---|---|
| Diameter of the nozzle | 10.0 mm |
| Diameter of the feed passage | 8.0 mm |
| Diameter of the feed opening in the filling piece | 1.8 mm |
| Diameter of the nozzle bores | 0.6 mm |
| Length of the turbulence chamber | 7.0 mm |

Figure 9:
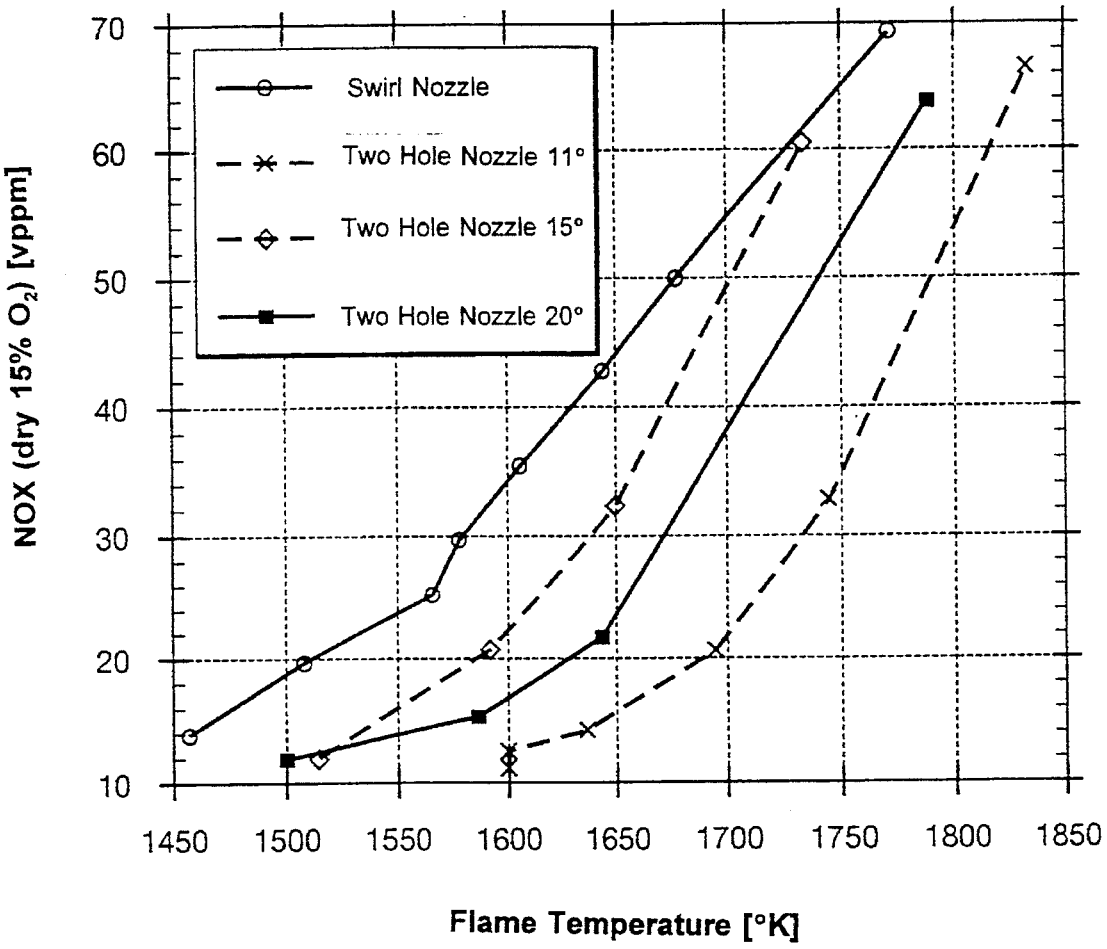
FIG. 9 shows a diagram for illustrating the dependency of the NOx emissions on the flame temperature of the double-cone burner for various nozzles.

FIG. 9 shows the dependency of the atmospheric NOx emission values on the flame temperature and the nozzle type used for atomizing the liquid fuel. Turbulence-assisted two-hole high-pressure nozzles having different angles β between fuel injection and burner axis were investigated (11°, 15°, 20°). The cone half angle α of the burner was 10.95° in each case. Compared with pressure atomization nozzles (swirl nozzles), substantially lower NOx emission values are achieved in premixing burners of the double-cone design when the high-pressure atomization nozzles 3 according to the invention having two nozzle bores 18 directed toward the air-inlet slots 19, 20 are used.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A premixing burner of the double-cone design for operating an internal combustion engine, a combustion chamber of a gas-turbine group, or a firing plant, the burner comprising:

at least two hollow conical sectional bodies positioned to enclose a conical interior space that widens in a direction of flow at a cone half angle which is constant in the direction of flow, longitudinal symmetry axes of the sectional bodies being parallel to a longitudinal axis of the burner and mutually offset to define opposed tangential flow air-inlet slots on opposite sides of the interior space for a combustion-air flow, a nozzle for atomizing a liquid fuel arranged in a narrowest cross section of the conical interior space, the nozzle being directed for fuel injection at an acute angle to the longitudinal axis of the burner, wherein the nozzle is a high-pressure atomization nozzle comprising a nozzle body having at least one feed passage for delivering liquid fuel to be atomized at a pressure greater than 100 bar, and at least two nozzle bores to spray fuel droplets into the interior space of the burner, wherein the nozzle bores are aligned with zones of high air velocity in the burner interior space, and the acute angle between the fuel-droplet spray and the longitudinal axis of the burner is at least as large as the cone half angle between the sectional cone bodies and the longitudinal axis of the burner.

2. The premixing burner as claimed in claim 1, wherein the nozzle bores of the high-pressure atomization nozzle are aligned with the air-inlet slots of the conical sectional bodies.

3. The premixing burner as claimed in claim 1, wherein the high-pressure atomization nozzle is a turbulence-assisted high-pressure nozzle having a turbulence chamber defined by a tube and a conical cap closing an outlet end of the tube, wherein the nozzle bores are positioned in the conical cap, and a filling piece having at least one feed opening separates the turbulence chamber from the at least one feed passage.

4. The premixing burner as claimed in claim 3, wherein the nozzle bores are arranged in a radially outer third of the conical cap close to a wall of the tube.

5. The premixing burner as claimed in claim 3, wherein the feed opening is arranged centrally in the filling piece.

6. The premixing burner as claimed in claim 1, wherein the high-pressure atomization nozzle is a high-pressure orifice nozzle which consists of a tube having a conical cap on an outlet end of the tube, and the nozzle openings are arranged in the conical cap.

7. The premixing burner as claimed in claim 6, wherein the nozzle bores are arranged in a radially outer third of the conical cap close to a wall of the tube.

8. The premixing burner as claimed in claim 1, further comprising means for introducing additional fuel in the tangential flow air inlet slots.

* * * * *